US006088968A

United States Patent [19]

Williston, Jr. et al.

[11] Patent Number: 6,088,968

[45] Date of Patent: Jul. 18, 2000

[54] BALED INSULATION MATERIAL BLOWING APPARATUS AND METHOD

[75] Inventors: Everett S. Williston, Jr.; Jack D. Coulter, both of Winter Haven, Fla.; Mark Trabbold, Harleysville, Pa.; Michael J. Noone, Wayne, Pa.; David S. Rivers, Thorndale, Pa.; Edward F. Pentz, Boyertown, Pa.

[73] Assignee: CertainTeed Corporation, Valley Forge, Pa.

[21] Appl. No.: 08/885,521

[22] Filed: Jun. 30, 1997

[51] Int. Cl.[7] ..... E04B 1/346

[52] U.S. Cl. ..... 52/64; 241/101.76; 241/101.742; 52/741.1; 406/32

[58] Field of Search ..... 52/741.1, 64, 109; 241/101.76, 101.742, 27, 33; 406/32, 39, 73, 122, 135, 164; 222/81, 181.1; 414/412

[56] References Cited

U.S. PATENT DOCUMENTS

| | | | |
|---|---|---|---|
| 1,703,466 | 2/1929 | Wright . | |
| 2,549,876 | 4/1951 | Williamson . | |
| 3,085,834 | 4/1963 | Woten et al. | 406/53 |
| 3,129,739 | 4/1964 | Wenger . | |
| 3,306,674 | 2/1967 | Diehm . | |
| 3,529,870 | 9/1970 | Woten | 406/53 |
| 3,722,717 | 3/1973 | Stryczek . | |
| 3,926,378 | 12/1975 | Ryan . | |
| 4,411,390 | 10/1983 | Woten | 241/98 |
| 4,662,221 | 5/1987 | Kaine et al. . | |
| 4,844,109 | 7/1989 | Navarro | 135/103 |
| 4,927,316 | 5/1990 | Kordel . | |
| 5,297,368 | 3/1994 | Okada | 52/64 |
| 5,333,799 | 8/1994 | Posthumus | 241/27 |
| 5,556,041 | 9/1996 | Cheesman et al. | 241/24.14 |
| 5,556,237 | 9/1996 | Rexius . | |
| 5,573,190 | 11/1996 | Goossen | 241/27 |
| 5,590,984 | 1/1997 | Assarsson . | |
| 5,653,394 | 8/1997 | Bussiere et al. | 241/101.742 |
| 5,738,287 | 4/1998 | Vanderberg | 241/101.76 |

FOREIGN PATENT DOCUMENTS 2072352 of 0000 United Kingdom .

*Primary Examiner*—Beth A. Stephan
*Attorney, Agent, or Firm*—Lalos & Keegan

[57] ABSTRACT

A wheeled system and a method for installing insulation from bound insulation bales. At least one movable wall that continually moves unbound insulation bales by a drive means toward a dispensing end of the base where shredding of the insulation from the unbound insulation bales occurs. The shredding is accomplished by a plurality of picker drums. Each of the picker drums has positioned on the circumference a plurality of abraders in the form of scoops that abrade and remove clumps of insulation from the unbound bales permitting the clumps to fall into a blender wherein the insulation material is formed into particulate material and then cast into an air blower formed with the hose and nozzle for dispensing the blowing material. A force measurer including a strain gauge is operatively connected to the shredder to determine continuously changes in the horizontally directed force exerted by the insulation bales against the drums of the shredder in order to adjust the force. The system can also include an electronic member for determining and monitoring the amount of insulation material dispensed and for automatically controlling the dispensing of insulation by the system.

62 Claims, 5 Drawing Sheets

BALED INSULATION MATERIAL BLOWING APPARATUS AND METHOD

BACKGROUND OF THE INVENTION

This invention relates generally to an apparatus and method for providing insulation materials in a simple economical manner for being applied to buildings or other structures. More particularly, the present invention is concerned with an apparatus and method for the economical and efficient application of particulate insulation materials from bales of insulation to the surfaces of buildings or other structures by pneumatically blowing or spraying such particulate insulation materials.

The types of insulation materials with which the present invention is concerned include generally but not exclusively fibers such as granulated rock wool, granulated mineral fiber wool, glass fiber materials, cellulose fibers, expanded mica, etc. This insulation material may be in particulate form and may be either blown dry or sprayed through a nozzle with liquid added to form an insulation and sealing coating on any surface. The insulation material has been blown on conventional walls and ceilings of places of habitation or working areas but also may be sprayed on any other surface as desired.

The insulation material used in conventional insulation spraying and blowing machines is typically in a relatively loose condition though usually packed under high compression in bags or sacks for shipment to the user. Upon being opened, these bags or sacks are typically manually emptied into the receiving hopper of a conventional insulation spraying and blowing machine. Prior U.S. Pat. No. 4,411,390 issued to Homer G. Woten recognizes the problems occurring from compressed masses of insulation material that normally would render the insulation material difficult to use in conventional apparatus that requires feeding through an air hose to a dispensing nozzle. To reduce these large masses, which may include nodules of the insulation material, separation into particulate form must be accomplished, although the insulation material may be to some extent mutually entwined and not be discreet. The term "particulate" as used hereinafter must be understood to include not only particles but also one or more intertwined or overlapping fibers and for convenience the term "particulate material" will therefore include materials formed as particles as well as fibers. These problems presented by the compacted materials have been overcome by the aforementioned patent as well as others held by the same patentee including U.S. Pat. Nos. 3,085,834 and U.S. Pat. 3,529,870.

To apply these insulation materials not only in particulate form as discussed above but also economically and efficiently, the desirable insulation blowing apparatus would be on a wheeled vehicle for convenience and economy of application. This necessitated a continuous supply of insulation filled bags or sacks with the insulation being emptied into the hopper of the insulation blowing machine. Because such hoppers had relatively limited capacity, continuous attention by an on site worker must be had to retrieving, opening and emptying the bags or sacks of insulation into the hopper and then disposing the bag or sack. Typically, that would be almost a full time occupation for such worker while a fellow co-worker was applying the insulation at the nozzle end of the hose attached to the blower. Such labor intensive operations have been found to be uneconomical and time consuming and therefore it would be desirable to have only a single operator at the nozzle end for applying the insulation while there is a continuous and more than adequate supply of insulation material always available for the blowing apparatus.

U.K. patent application GB 2072352A published Sep. 30, 1981, but later withdrawn, has attempted to meet some of the concerns of the prior art by incorporating the use of bales that are loaded onto the side of a truck that possesses a moving floor structure to carry the bales towards a conventional blower for dispensing the insulation. The bales and the means of banding, if any, are not otherwise identified but are nevertheless said to be urged by the moving floor towards the hopper of the conventional insulation blower where the bales are alleged to be broken up so that the insulation can be blown out through the hose attached to the blower. No conventional blowing apparatus could receive any tightly compacted bale of insulation material and efficiently and economically generate particulate material necessary for entering the blowing apparatus. Accordingly, it is believed that this attempt to provide the necessary supply of insulation material to the blowing apparatus would not achieve its purpose because either the bales would be too loose and fall apart before loading or if tightly compacted would take a long time to be broken up by conventional blowing apparatus into necessary particulate form. Thus in either case, this described process would produce, if not inoperative, an unsuccessful and uneconomical insulation blowing technique.

Accordingly, it is the principal object of the present invention to provide for the continuous supply of baled insulation material to a unique insulation bale receiving apparatus that disengages the insulation from the bale so that it may be accepted by and dispensed through a conventional air blower onto a surface to be insulated.

Another object of the invention is to provide a means for electronically determining and monitoring the amount of insulation material dispensed by the system and for automatically controlling the dispensing of insulation based on various pre-selected parameters.

SUMMARY OF THE INVENTION

A system and a method for installing insulation from bound insulation bales in which the bales are supported on an elongated base with surrounding stationary side walls where the straps binding the bales may be removed through strap removal doors. At least one movable wall that is positioned between the side walls and transversely to the base continually moves the unbound insulation bales by a drive means toward a dispensing end of the base where shredding of the insulation from the unbound insulation bales occurs. The shredding is accomplished by a plurality of picker drums rotating about adjacent vertical axes supported and journaled by a cross bar extending above and athwart the base. Each of the picker drums has positioned on the circumference a plurality of abraders in the form of scoops that abrade and remove clumps of insulation from the unbound bales permitting the clumps to fall into a blender wherein the insulation material is formed into particulate material and then cast into an air blower formed with the hose and nozzle for dispensing the blowing material. To maintain the proper force of the bales against the rotating drums forming the shredder, a force measurer is operatively connected to the shredder to determine continuously the horizontally directed force exerted by the insulation bales against the drums of the shredder. The force measurer includes a strain gauge to measure the deflection in the cross bar caused by the force of the insulation bales against the drums of the shredder and adjust the force produced by the drive means. Preferably the present invention is a wheeled vehicle for transporting the system.

The system may preferably include an electronic means for determining and monitoring the amount of insulation material dispensed, for automatically shutting the system down once a preselected amount of insulation has been dispensed, or for otherwise automatically controlling the dispensing of insulation based on various pre-selected parameters.

THE DRAWINGS

Figure 1:
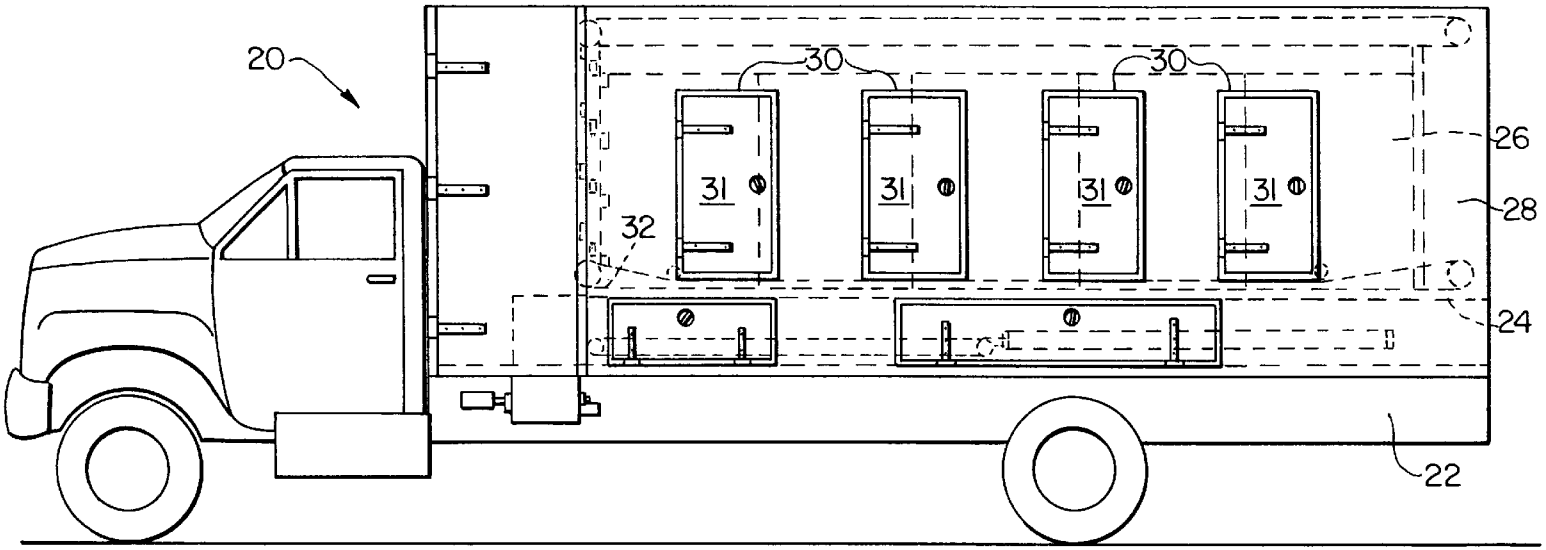
FIG. 1 is a side elevational view of the vehicle having thereon the baled insulation blowing apparatus of the present invention and illustrating the side walls and the side doors therein for strap removal from the bales and also showing the outlet from the air blower.
Figure 4:
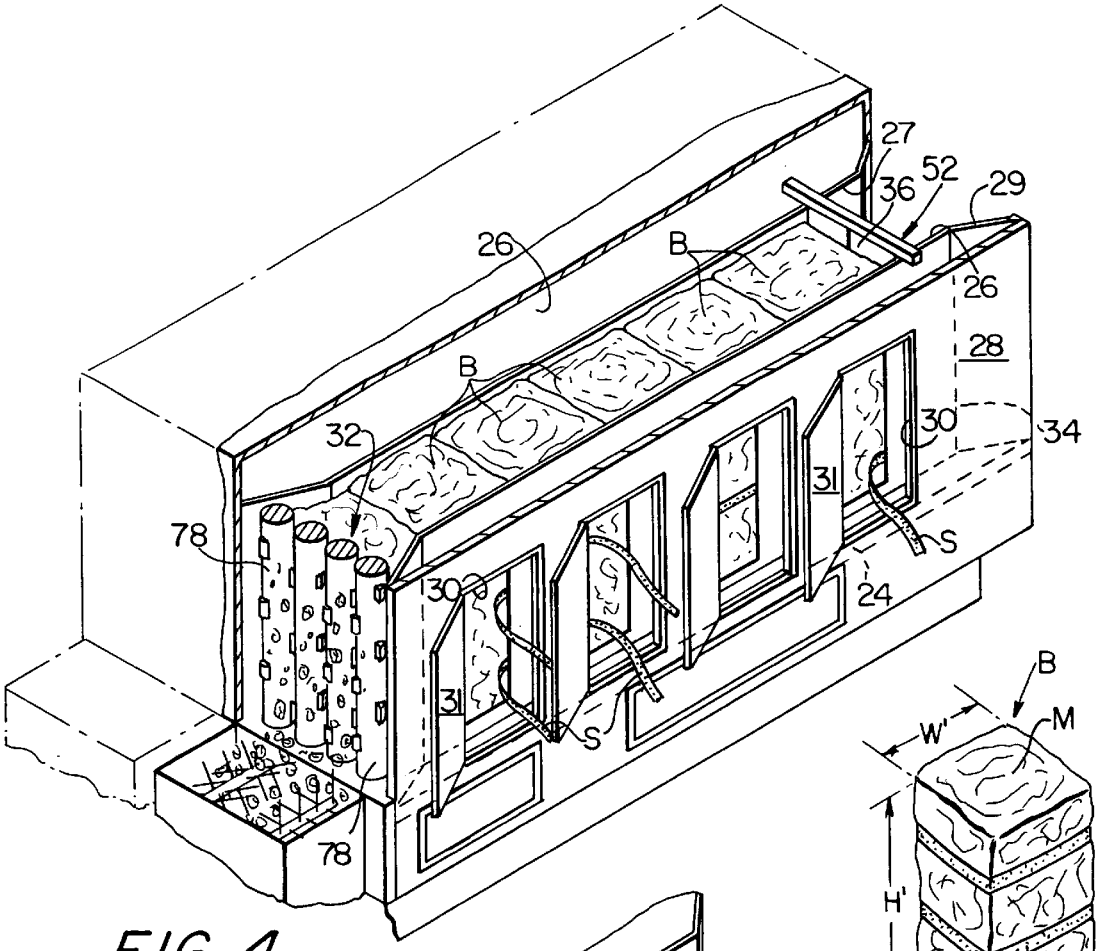

FIG. 4 is a perspective view partially cut away and partly in phantom lines illustrating the same left side of the vehicle as in FIG. 1 wherein the bales are illustrated to have been loaded onto the base of the vehicle and the strap removal doors open to reveal the straps surrounding the bales being partially removed. Also shown are the vertically positioned picker drums abrading the bales of insulation material to have it fall into the blender.

Figure 5:
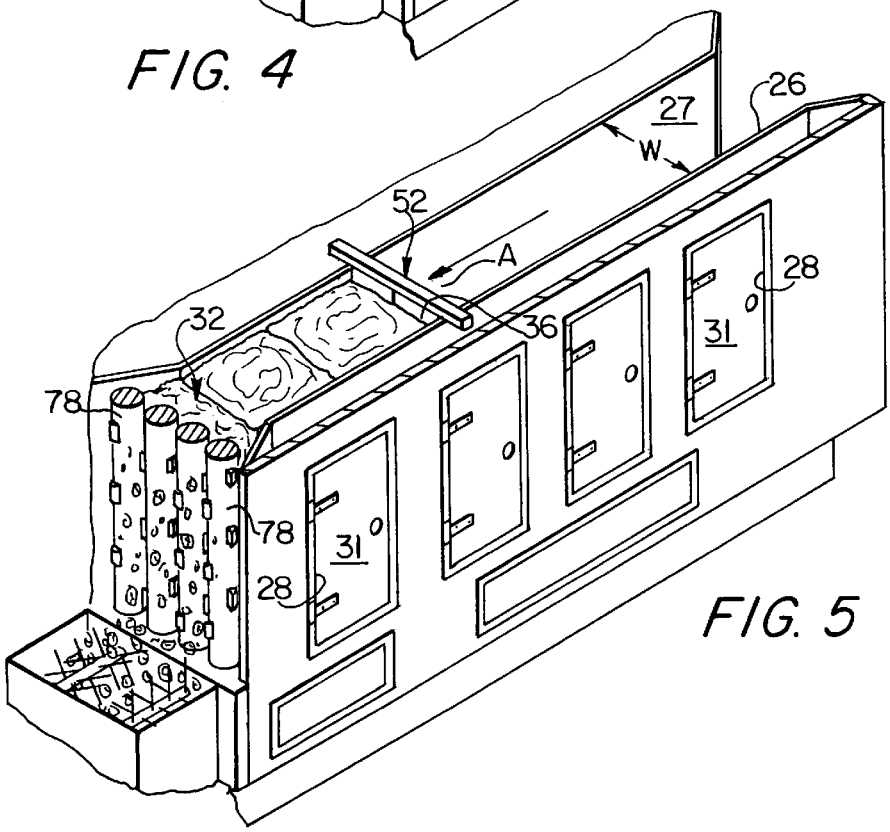

FIG. 5 is a perspective view partly broken away and similar to the showing of FIG. 4 but illustrating the movement of the movable wall forcing the unbound bales of insulation material toward the bale receiving end that includes the rotating picker drums for shredding and abrading the insulation from the unbound bales.

Figure 6:
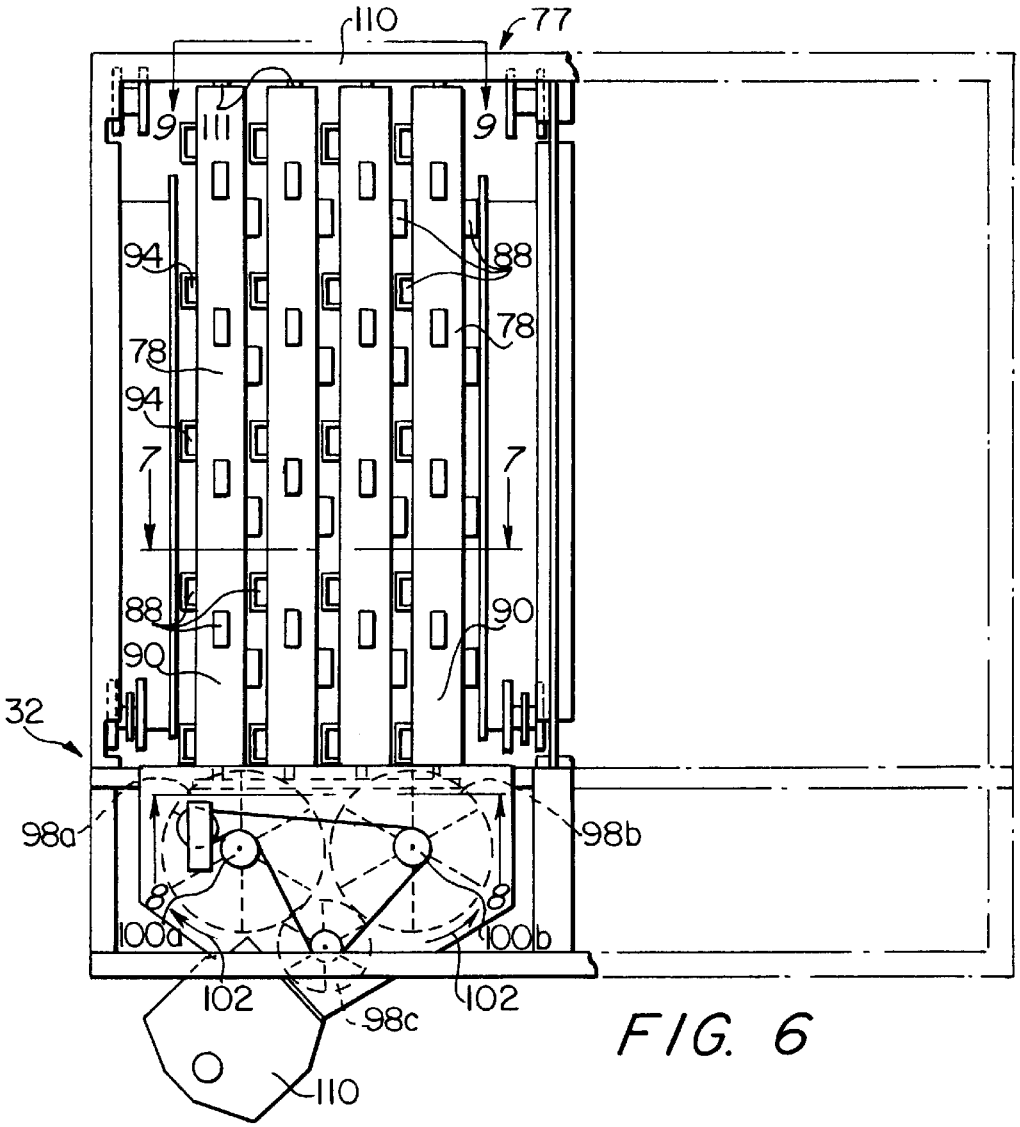

FIG. 6 is a front elevational view of the left side of the vehicle embodying the insulation blowing system of the present invention with the identical opposite right side shown in phantom lines. Particularly seen in this figure are the picker drums forming the shredder and the scoops distributed along the circumference of each of the drums. In dotted lines are shown the three blenders while the air lock forming the air blower with outlet can also be seen.

Figure 7:
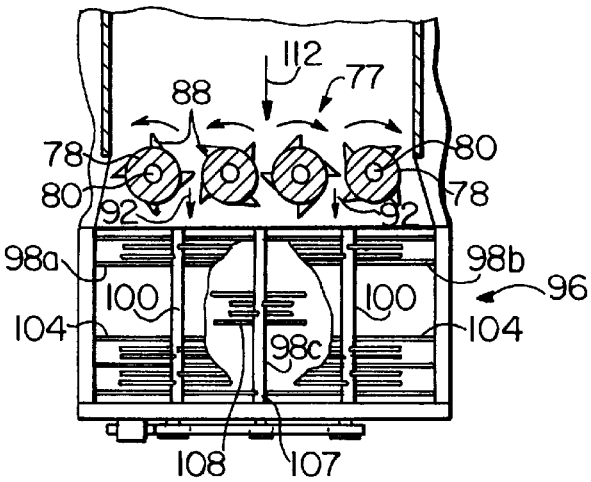

FIG. 7 is a cross sectional view partly broken away and taken along lines 7—7 of FIG. 6 illustrating the rotation of the picker drums forming the shredder and also illustrating the several blenders and the cooperation of the various axes of rotating fingers.

Figure 8:
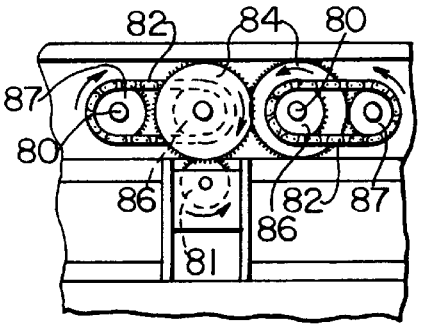

FIG. 8 is a view partly broken away and taken along lines 8—8 of FIG. 6 to illustrate the gear arrangement for the rotation of the picker drums forming the shredder of the present invention.

Figure 9:
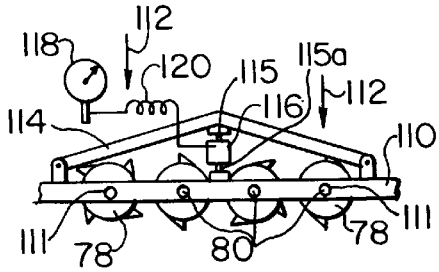

FIG. 9 is a view taken along lines 9—9 of FIG. 6 and partly broken away illustrating the force measurer and the strain gauge connection to the controller of the drive means forming the force urging the movable walls and the bales of insulation toward the shredder.

Figure 10:
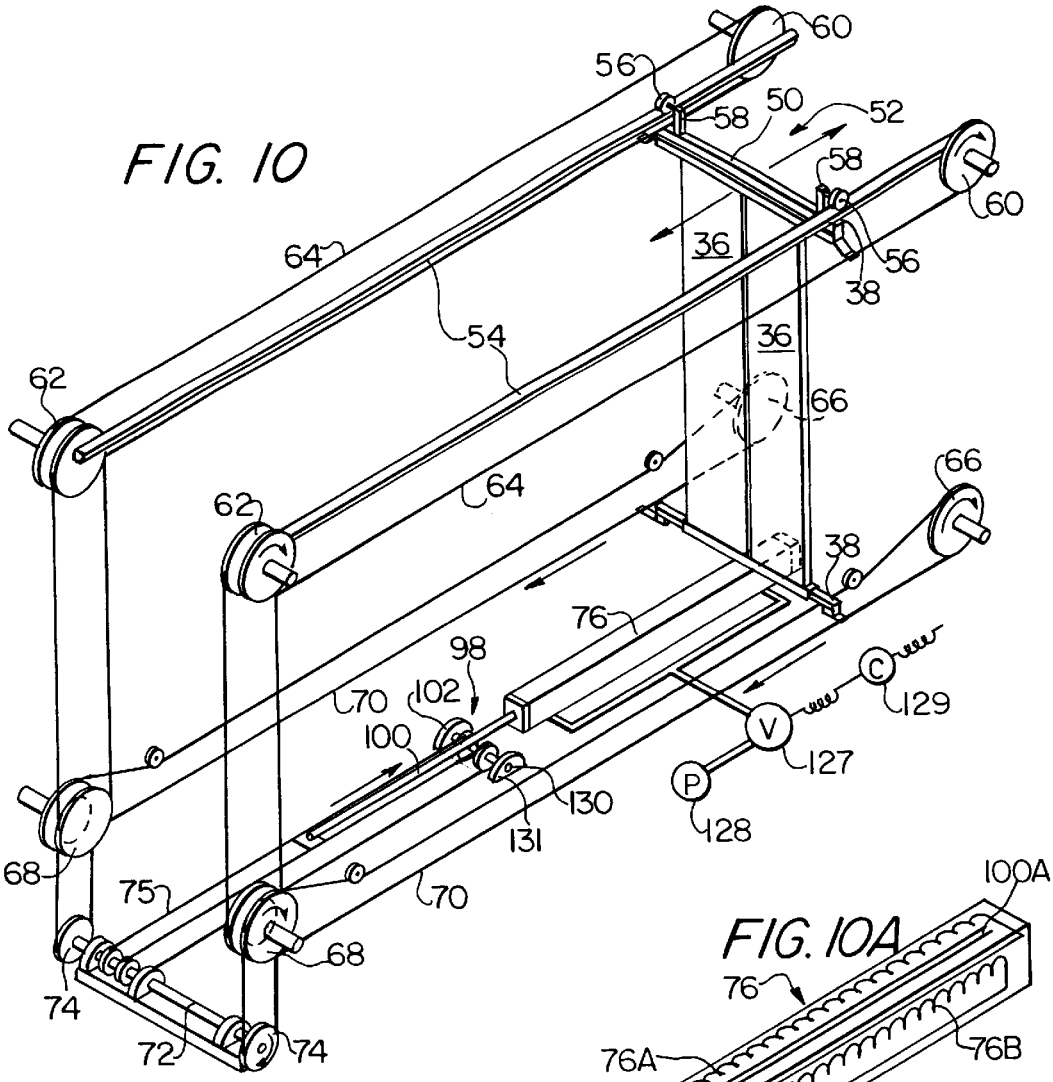

FIG. 10 is a schematic skeleton view of the drive system for one pair of movable doors forming the movable wall including the interconnecting chain system, the ram drive means for operating the chains, and the gear arrangement that is cooperatively associated with the ram to actuate the electronic means for determining and monitoring the amount of insulation dispensed by the system and that may in turn otherwise control the dispensing of insulation material by the system based on various pre-selected parameters.

Figure 10A:
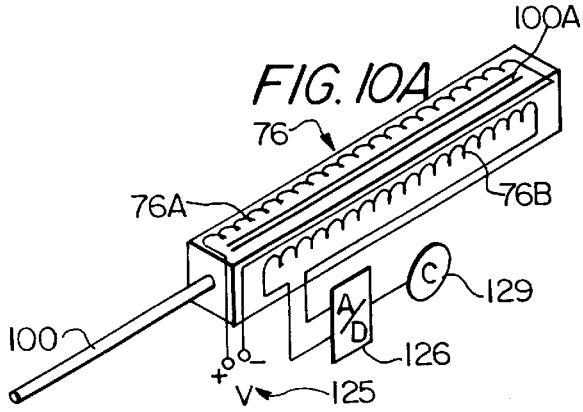

FIG. 10A is a diagram illustrating Linear Voltage Differential Transformer embodiment of a position transducer.

Figure 10C:
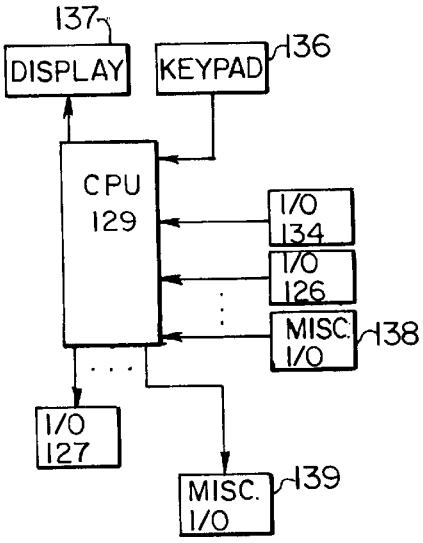
Figure 10B:
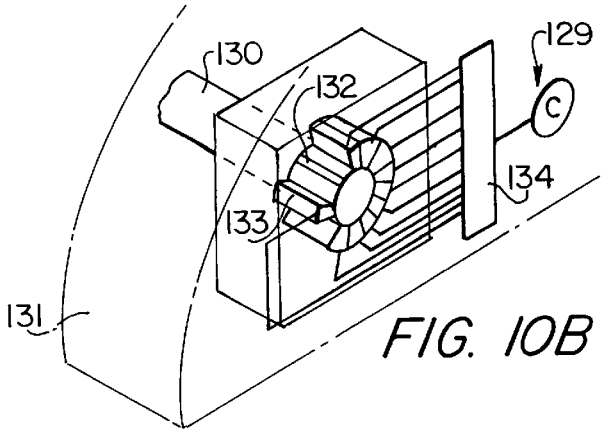

FIG. 10B is a diagram illustrating a rotary encoder embodiment of a position transducer.

FIG. 10C is a block diagram illustrating the signal receiving means of the present invention embodied in a computer and associated peripherals.

Figure 11:
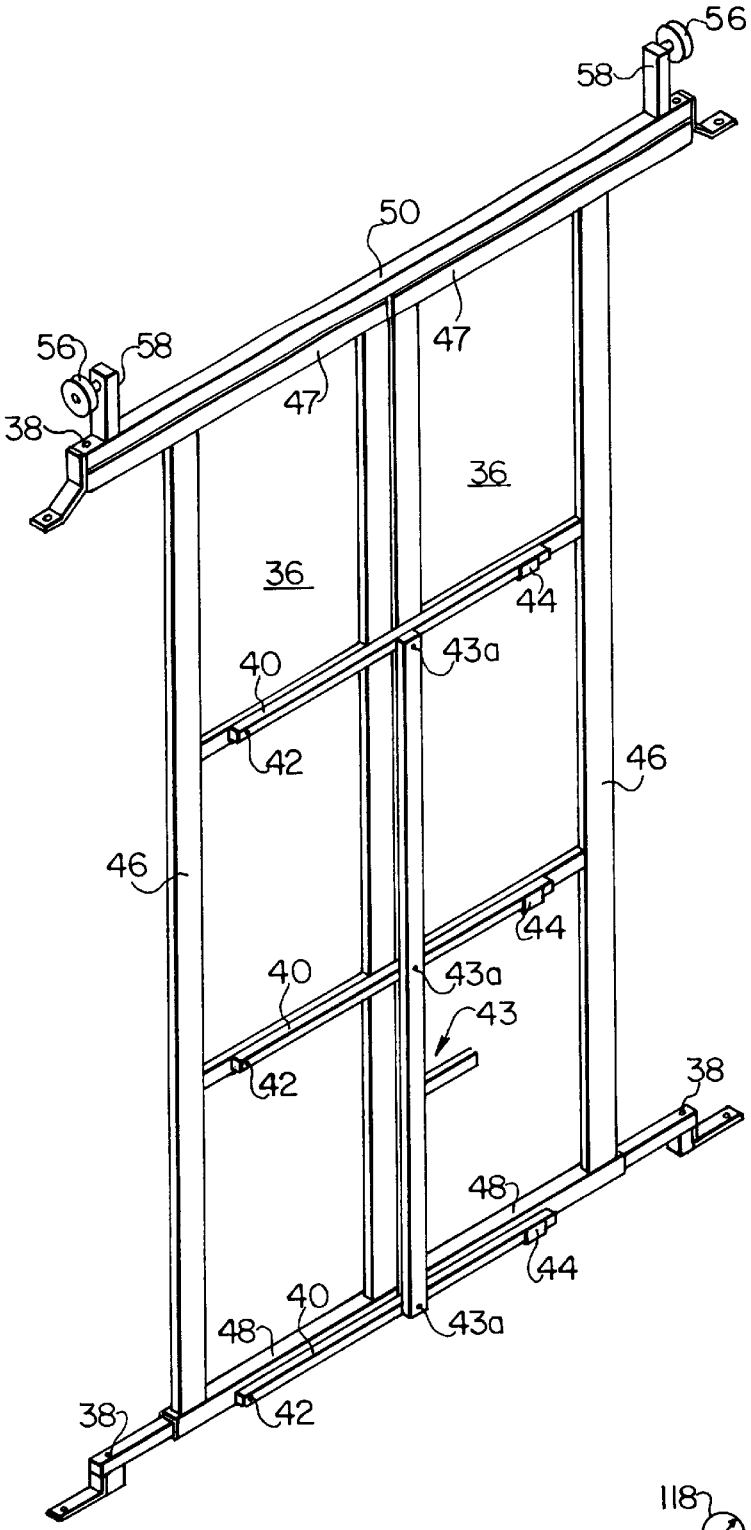

FIG. 11 is a perspective view of the rear of a pair of the movable wall door s forming the movable wall showing the latch arrangement and also the support and rollers for the movable doors.

DESCRIPTION OF THE PREFERRED EMBODIMENTS

FIG. 1 discloses at 20 the wheeled vehicle in the form of a truck representative of the present invention. The truck 20 includes a chassis 22 on which is positioned an elongated flat horizontal base 24 shown in phantom lines in FIG. 1 but also shown in the end view of the truck at 22 of FIG. 2. The truck as best shown in FIGS. 1 and 2 and 4 and 5, includes an inner area A having outer wall 26 and an inner wall 27 that extends the length of the ba s e 24. Outside walls 28,28 form the outermost boundaries of the truck 20 and are connected to each outer wall 26 by connecting wall 29. Outer wall 26 is provided with a plurality of openings 30 that receive doors 31 suitably hinged at 38, as shown in FIGS. 10 and 11, for opening and closing to gain admittance to area A between the walls 26 and 27 as best shown in FIG. 5.

Figure 2:
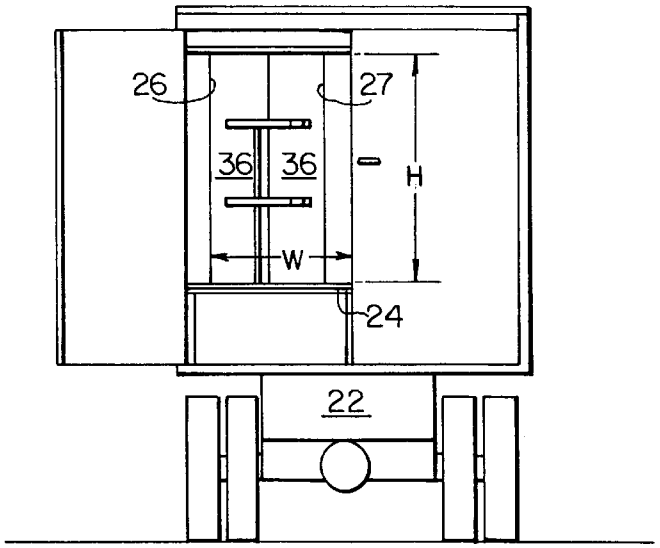
FIG. 2 is an end elevational view of the vehicle at FIG. 1 with the rear door open and illustrating only the left side of the interior of vehicle and a pair of the movable doors forming the movable wall with accompanying latches to keep the doors closed. The right hand side interior is identical to the left hand side.
Figure 3:
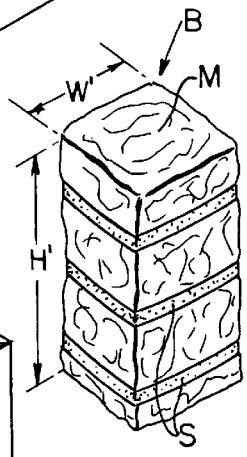
FIG. 3 is a perspective view of a typical bale of insulation material illustrating the plurality of straps surrounding the insulation forming the bale.

The area A has a width W and height H as shown in FIGS. 2 and 5. The height H may be 1–3 times or more the height H' of the bale B while the width W corresponds very roughly to the width W' of the bale B of the insulation material M as shown in FIG. 3. The insulation material M is bound into the shape of the bale by a plurality of straps S that surround the bale B to form a bound bale of insulation material as shown in FIG. 3. The bales are loaded onto the base 24 as shown in FIGS. 2, 4 and 5. A truckload of bales B can be expected to constitute a full day's supply for an on site blowing job.

The bales B are urged by a controllable force towards the dispensing end 32 as shown in phantom lines in FIG. 1 and in solid lines in FIG. 5. At the opposite or distal end 34 of the base the bales B are loaded through a pair of movable doors 36.

As shown, the doors are hinged at suitable pivot points 38 so that the individual doors 36,36 open when latch members 40 are raised about latch pivots 42, as shown in FIG. 11. The latches 40 in the form of elongated bars that are received for security locking in latch receptacle 44 for each of the latch bars 40. The latch bars 40 are removed from the latch bar receptacle 44 by raising handle 43 pivotally connected to each latch member 40 at the plurality of pivots 43*a*. Each latch bar 40 is then pivotally raised to a substantially upright position so that doors 36,36 may swing outwardly away from the base 24 that is then ready for loading of the bales B in their bound form with the straps as shown in FIG. 3.

The movable doors 36 are held in a support structure including upright bar members 46 on the outer pivot side of the doors 36,36 and are supported by horizontal upper 47,47 and lower 48,48 support members. Top support member 50 as shown in FIGS. 10 and 11 provides support for the pivoting doors 36,36 about pivots 38. The movable doors 36,36 may be referred to in unitary form as movable wall 52, which includes the pivoting and movable doors 36,36 as well as the upper 47,47 and lower 48,48 support members.

As shown in FIG. 10, movable wall 52 is suitably supported by a pair of parallel rails 54,54 upon which movable wall 50 travels through the use of suitable rollers 56,56 that are each secured to vertical extension arms 58,58 connected to and protruding upwardly from the top support member 50.

A system of pulleys including those upper pulleys 60,60 at one end and those at the bale receiving end 32 as shown at 62,62 operate with corresponding chains 64,64 to pull the movable wall 52 forwardly or rearwardly.

A similar pulley and chain arrangement at the bottom of the movable wall 52 is shown at pulleys 66,66 at one end and 68,68 at the other end operating with chains 70,70 to operate in unison with chains 66,64 and their corresponding pulleys. Driveshaft 72 and accompanying pulleys 74,74 are operated through chains 75,75 by hydraulic ram 76, powered by conventional hydraulic pump P and controlled by valve V operated by controller C for purposes to be described hereinafter.

As shown in FIGS. 4, 5, 6 and 7 particularly, the dispensing end 32 toward which the movable wall 52 forces the unbound bales of insulation material includes a shredder 77 having plurality of picker drums 78 that are shown only for illustrative purposes to be four a number in the drawings. However the number of such picker drums 78 is not critical and could be more or less than the four shown. Each picker drum is rotated about its own vertical axis 80 through drive gear 81 (power source not shown) and by a combination of a series of conventional endless chains 82,82 rotated by large gears 84,84 and small gears 86,86 integral with the large gears to in turn rotate independent gears 87,87 by the connected chains 82,82, so that the gears and therefore the picker drums 78 rotate in the direction shown by the arrows in both FIGS. 7 and 8.

The picker drums 78 are provided on their circumference with a plurality of abraders or scoops 88 that protrude from the circumference 90 of each of the picker drums 78. The picker drums 78 perform a shredding or abrading function on contact with the unbound bale of insulation material M. As the drums 78 rotate, as shown in FIG. 7, the insulation material is torn off the bale in clumps or chunks and forced forwardly in the direction of the arrows 92,92. The abraders or scoops 88 preferably each have a concave surface 94 facing in the direction of rotation of the picker drums 78 that scoops the insulation material as it abrades the material from the unbound bale and directs it into the blending section 96 having a plurality of blenders including an upper pair of blenders 98*a* and 98*b* and a lower blender 98*c*. The upper pair of blenders 98*a*,98*a* as best shown in FIGS. 6 and 7, rotates about axes 10*a* and 100*b* respectively in opposite directions as shown by the arrows 102 to receive the chunks or clumps of torn off or abraded insulation material from the unbound bales. The blenders 98*a* and 98*b* rotating about the respective axes 100*a*,100*b* break up the chunks or clumps of insulation material that may contain nodules or other groupings of the insulation material. As the radial fingers 104 rotate at high fingertip speed, the nodules are broken up to form particles of particulate material. It is preferable, though not necessary, that the fingers 104 of the large blenders 98*a* and 98*b* rotate about the axes 100*a*,100*b* to achieve a tip speed within the maximum range of 250 to 4,000 inches per second. Preferably, though very much dependent upon the particular type of insulation material used, the tip speed can be in the range of 800 to 1,200 inches per second but may rise to around 2,000 or higher inches per second.

The insulation material passing through the counter rotating top two blenders 98*a* and 98*b* then is urged down to a blender 98*c* of lesser diameter but one that may be of increased tip speed rotating on axis 107. Particularly the fingers 108 of the lower blender 98*c* shown in FIG. 7 rotate at a tip speed of between 500 and 4,000 inches per second and again depending upon the type of material passing through, the tip speed for the lower blender 98*c* should be higher than the top two blenders 98*a* and 98*b*.

The blender 98*c* receives the conditioned insulation particulate material free of nodules and in the form of particles that may then pass into the conventional air lock blower 110. This air lock may be of the type disclosed in above mentioned U.S. Pat. No. 4,411,390 issued to Homer G. Woten.

In order to optimize the force of the moving wall 52 in urging the unbound bales B of insulation material M towards the shredders or picker drums 78 and maintain a relatively constant force, the axes 80 of the picker drums 78, as shown in FIGS. 6 and 9 are journalled at 111 into cross bar 110. Then when the bales of insulation material move in the direction of arrows 112 (see FIGS. 7 and 9) towards the picker drums 78, any deflection of the cross bar 110 due to the force of the movement of the bales would be detected by A-frame 114 to which is attached conventional strain gauge 116 at one end 115 and at the other end 115*a* to the cross bar 110. In this manner, it is possible to detect the most minute deflections of the bar 110 due to the force of the bale movement. Any such deflections may either be denoted on dial 118 through lead 120 or the signals generated due to the change in force may be carried by lead 120 to previously identified controller C in FIG. 10 to modulate the flow of fluid through valve V into the ram 76. This modulation permits the maintenance of the force of the moving wall 52 constant against the bales B and thus against the picker drums or shredders 78. With a constant pre-selected force the volume or weight of insulation material M that is carried through the system of the present invention will be uniform and thus the operator at the nozzle (not shown) will be able to spray a relatively uniform amount of insulation material onto the surface of choice.

The present invention also includes a quantitative determinator to determine the amount of insulation dispensed at the dispensing end 32. To this end gear arrangement 98 in FIG. 10 includes ram rod 100 that during movement in and out from hydraulic ram 76, rotates gear 102. A position transducer may further be associated with gear arrangement 98 to provide an electrical signal proportional to the amount by which ram rod 100 is displaced from its base position within hydraulic ram 76. Although many means are known in the art for accomplishing the task of determining position by way of a transducer, two popular means are shown in FIG. 10A and FIG. 10B.

The linear position of ram rod 100 may be directly translated by way of a Linear Voltage Differential Transformer (LVDT) disposed within hydraulic ram 76 as best shown in FIG. 10A. Voltage 125 may be applied to primary windings 76A that are wound in such a manner that ram rod 100 forms core 100A between primary windings 76A and secondary windings 76B. Motion of ram rod 100 will change the position of core 100A and thus affect the permeability of the coupling between primary 76A and secondary 76B windings. A change in permeability affects the magnetic coupling between primary 76A and secondary 76B windings and thus varies the voltage output in proportion to movement of core 10A. Such variable voltage output may be read at analog to digital converter 126 and may be output in digital form to computer 129. Upon proper zero to full scale calibration of the LVDT, the digital output of analog to digital converter 126 will be proportional to the linear displacement of ram rod 100 from its base position to its fully extended position.

Alternatively, the linear displacement of ram rod 100 may be determined by rotary encoder 135, best shown in FIG. 10B, that may be mounted within shaft support 131 shown in FIG. 10 and FIG. 10B. Gear shaft 130 for gear 102 may be provided with a magnetic element 132 that rotates directly with shaft 130. As shaft 130 rotates, element 132 moves in proximity to pick-up sensors 133 disposed around the circumference of shaft 130 as it extends into the housing of rotary encoder 135. Pick-up sensors 133 provide electrical signals to signal encoder 134. Signal encoder 134 is capable of determining the direction (sign) as well as the magnitude of the movement of ram rod 100 generated based rotate rotation of shaft 130. Signal encoder 134 converts rotational signals from sensors 133 into a sign-magnitude value determinative of both the direction and magnitude of linear displacement of ram rod 100 which is then readable by computer 129, or like receiving means.

In one embodiment, as best shown in FIG. 10*c*, the receiving device comprises computer 129 that can be programmed by an operator using key pad 136 with various parameters such as the desired R-Value of the insulated structure to be insulated, the size, usually the surface area, of the structure to be insulated, the density of the material being dispensed, the identity of the material, the size of the bale, etc. and/or other parameters. With this information computer 129 can be programmed to automatically control the dispensing of insulation or to shut down the system when an appropriate amount of insulation has been dispensed by sending an appropriate control signal to valve 127. In addition, controls for other elements of the system may be integrated into computer 129 using, for example, I/O ports 138 and 139 for sensing additional parameters and controlling additional elements. The amount actually dispensed is determined, as above set forth, by the input generated from rotary encoder 135 and the parameters stored in computer 129. In another embodiment, computer 129 is programmed to shut the blowing device down for a relatively short period of time at pre-selected intervals so that an operator who is dispensing insulation at a remote location can be made aware of the amount of insulation remaining in the system by reading display 137 which can be placed at any convenient location. In this manner, a remote operator can, for example, be made aware of the fact that the system has dispensed 25%, 50% and/or 75% of the total amount of insulation to be blown into a structure.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. A system for installing insulation from bound insulation bales comprising:

an elongated base for supporting said insulation for longitudinal movement relative to said base, said base having a dispensing end for said insulation and a distal end remote therefrom, at least one movable wall transverse to said base for moving said insulation from said distal end toward said dispensing end, insulation bale receiving apparatus positioned at said dispensing end for disengaging said insulation from said bales, an air blower for blowing said insulation out from said system onto a surface to be insulated.

2. The system of claim 1 including, said base being part of a wheeled vehicle.

3. The system of claim 1 including, said movable wall being operably moved by drive means secured to said wall.

4. The system of claim 3 including, said drive means including chains secured to said wall for moving said wall and said bales along said base toward or away from said dispensing end.

5. The system of claim 1 including, said base having a pair of side walls and a top connecting said side walls and being substantially coextensive with said base.

6. The system of claim 5 including, guide rails positioned on said side walls and operatively connected to said movable wall to permit said movable wall to move along a predetermined path between said side walls.

7. The system of claim 1 including, said movable wall being operably moved by drive means secured to said wall, said drive means including chains secured to said wall for moving said wall and said bales along said base toward or away from said dispensing end, said base having a pair of side walls and a top connecting said side walls and being substantially coextensive with said base, and guide rails positioned on said side walls and operatively connected to said movable wall to permit said movable wall to move along a predetermined path between said side walls.

8. The system of claim 1 including, said insulation bale receiving apparatus comprising a shredder to disengage insulation from said insulation bales and a blender positioned between said shredder and said air blower to receive said insulation disengaged from said bales and condition said insulation before entering said air blower.

9. The system of claim 8 including, said shredder comprising at least one vertically positioned drum rotatable about a vertical axis toward which said movable wall moves said bales.

10. The system of claim 9 including, said at least one drum having a circumference upon which is positioned a plurality of abraders extending outwardly from said circumference for disengagement of the insulation from said bales.

11. The system of claim 10 including, said at least one drum rotatable by a second drive means.

12. The system of claim 8 including, said shredder comprising a plurality of drums rotatable about adjacent vertical axes.

13. The system of claim 11 including, said drum having positioned thereon a plurality of abraders extending outwardly therefrom.

14. The system of claim 8 including, a force measurer operatively connected to said shredder to determine the force exerted by said insulation bales against said shredder.

15. The system of claim 14 including, said shredder comprising a plurality of drums rotatable about respective adjacent vertical axes thereof and supported by a cross bar extending above and athwart said base, said force measurer being a strain gauge means measuring deflection in said cross bar caused by the force of said insulation bales against said drums.

16. The system of claim 10 including, said abraders being shaped in the form of scoops opening outwardly from said drums to contact said bales.

17. The system of claim 1 including, said at least one movable wall being at least a pair of doors arranged to open outwardly beyond said base to receive a plurality of said insulation bales.

18. The system of claim 17 including, said base having a pair of side walls and a top connecting said side walls and being substantially coextensive with said base, guide rails positioned on said side walls and operatively connected to said movable wall to permit said movable wall to move along a predetermined path between said side walls, and said insulation bale receiving apparatus comprising a shredder to disengage insulation from said insulation bales and a blender positioned between said shredder and said air blower to receive said insulation disengaged from said bale and condition said insulation before entering said air blower.

19. The system of claim 17 including, said base having a pair of side walls and a top connecting said side walls and being substantially coextensive with said base, guide rails positioned on said side walls and operatively connected to said movable wall to permit said movable wall to move along a predetermined path between said side walls, said insulation bale receiving apparatus comprising a shredder to disengage insulation from said insulation bales and a blender positioned between said shredder and said air blower to receive said insulation disengaged from said bale and condition said insulation before entering said air blower, said shredder comprising at least one vertically positioned drum rotatable about a vertical axis toward which said movable wall moves said bales, and said at least one drum having a circumference upon which is positioned a plurality of abraders extending outwardly from said circumference for disengagement of the insulation from said bales.

20. The system of claim 17 including, said base having a pair of side walls and a top connecting said side walls and being substantially coextensive with said base, guide rails positioned on said side walls and operatively connected to said movable wall to permit said movable wall to move along a predetermined path between said side walls, said insulation bale receiving apparatus comprising a shredder to disengage insulation from said insulation bales and a blender positioned between said shredder and said air blower to receive said insulation disengaged from said bale and condition said insulation before entering said air blower, said shredder comprising at least one vertically positioned drum rotatable about a vertical axis toward which said movable wall moves said bales, said at least one drum having a circumference upon which is positioned a plurality of abraders extending outwardly from said circumference for disengagement of the insulation from said bales, said at least one drum rotatable by a second drive means, and a force measurer operatively connected to said shredder to determine the force exerted by said insulation bales against said shredder.

21. The system of claim 17 including, said base having a pair of side walls and a top connecting said side walls and being substantially coextensive with said base, guide rails positioned on said side walls and operatively connected to said movable wall to permit said movable wall to move along a predetermined path between said side walls, said insulation bale receiving apparatus comprising a shredder to disengage insulation from said insulation bales and a blender positioned between said shredder and said air blower to receive said insulation disengaged from said bale and condition said insulation before entering said air blower, said shredder comprising at least one vertically positioned drum rotatable about a vertical axis toward which said movable wall moves said bales, said at least one drum having a circumference upon which is positioned a plurality of abraders extending outwardly from said circumference for disengagement of the insulation from said bales, a force measurer operatively connected to said shredder to determine the force exerted by said insulation bales against said shredder.

22. The system of claim 5 including, a plurality of access doors positioned in at least one of side side walls and extending substantially the height of said side wall providing access to said bound insulation bales for unbinding said bales.

23. The system of claim 8 including, said blender comprising a plurality of rotating fingers to receive said disengaged insulation from said insulation bales and propel said insulation into said air blower.

24. The system of claim 23 including, said air blower being an air lock and having an outlet for blowing said insulation onto said surface.

25. The system of claim 14 including, a drive means for said movable wall, said force measurer being capable of generating signals representing a change in said force, and a control for said drive means sensitive to said signals for controlling the movement of said wall against said insulation bales.

26. A system for controlling the installing of insulation from bound insulation bales comprising:

an elongated base for supporting said insulation for longitudinal movement relative to said base, said base having a dispensing end for said insulation and a distal end remote therefrom, a movable force providing surface being transverse to said base for moving said insulation from said distal end toward said dispensing end, insulation bale receiving apparatus positioned at said dispensing end for disengaging said insulation from said bales, said surface moving said bales toward said receiving apparatus with a controllable force, an air blower for blowing said insulation out from said system onto a surface to be insulated.

27. The system of claim 26 including, a force measurer operatively connected to said insulation bale receiving apparatus capable of generating signals representing a change in the force on said receiving apparatus.

28. The system of claim 27 including, said insulation bale receiving apparatus comprising a shredder to disengage insulation from said insulation bales and a blender positioned between said shredder and said air blower to receive said insulation disengaged from said bales and condition said insulation before entering said air blower.

29. The system of claim 28 including, said force measurer operatively connected to said shredder to determine the force exerted by said insulation bales against said shredder.

30. The system of claim 29 including, said shredder comprising a plurality of adjacent drums rotatable about respective vertical axes thereof and supported by a cross bar extending above and athwart said base, said force measurer being a strain gauge means measuring deflection in said cross bar caused by the force of said insulation bales against said drums.

31. A method for installing insulation from bound insulation bales comprising:

supporting said bound insulation bales on an elongated base, unbinding said bound insulation bales to produce unbound insulation bales, moving said unbound insulation bales relative to said base toward a dispensing end from a distal end of said base, disengaging said insulation from said unbound insulation bales, directing said insulation into an air blower for dispensing said insulation.

32. The method of claim 31 including, binding each said bound insulation bales with straps encircling each said bales individually.

33. The method of claim 31 including, providing wheels on said base for transporting said base.

34. The method of claim 31 including, said disengaging being shredding of said insulation from said unbound insulation bales.

35. The method of claim 31 including, blending said insulation following said disengaging, said directing being a casting of said insulation from said blending step into said air blower.

36. A method for installing insulation in bound insulation bales comprising:

supporting said bound insulation bales on an elongated base, moving said bound insulation bales relative to said base toward a dispensing end from a distal end of said bas e remote therefrom with a controllable force, disengaging said insulation from said unbound insulation bales, and directing said insulation into an air blower for dispensing said insulation.

37. The method of claim 36 including, measuring said force during said disengaging step, and controlling said force in accordance with said measuring.

38. The method of claim 37 including, said measuring of said force being with a strain gauge to determine deflections caused by said force.

39. The method of claim 36 including, said disengaging being by shredding from a shredder comprising a plurality of drums, and rotating said drums.

40. The method of claim 36 including, blending said insulation following said disengaging to produce a substantial uniformity density, and said directing being a casting of said insulation from said blending step into said air blower.

41. The method of claim 36 including, binding each said bound insulation bales with straps encircling each said bales individually.

42. The method of claim 36 including, unbinding said bound insulation bales to produce unbound insulation bales.

43. The method of claim 36 including, binding each said bound insulation bales with straps encircling each said bales individually.

44. The method of claim 36 including, said disengaging being shredding of said insulation from said unbound insulation bales.

45. The method of claim 36 including, measuring said force during said disengaging step, controlling said force in accordance with said measuring, and said measuring of said force being with a strain gauge to determine deflections caused by said force.

46. The method of claim 36 including, measuring said force during said disengaging step, controlling said force in accordance with said measuring, said measuring of said force being with a strain gauge to determine deflections caused by said force, said disengaging being by shredding from a shredder comprising a plurality of drums, and rotating said drums.

47. The method of claim 36 including, binding each said bound insulation bales with straps encircling each said bale individually, said disengaging being shredding of said insulation from said unbound insulation bales, said disengaging being by shredding from a shredder comprising a plurality of drums, and rotating said drums.

48. The method of claim 36 including, binding each said bound insulation bales with straps encircling each said bales individually, said disengaging being by shredding from a shredder comprising a plurality of drums, rotating said drums, measuring said force during said disengaging step, and controlling said force in accordance with said measuring.

49. The method of claim 36 including, binding each said bound insulation bales with straps encircling each said bale individually, said disengaging being by shredding from a shredder comprising a plurality of drums, rotating said drums, measuring said force during said disengaging step, controlling said force in accordance with said measuring, and said measuring of said force being with a strain gauge to determine deflections caused by said force.

50. The method of claim 36 including, blending said insulation following said disengaging to produce a substantial uniform density, said directing being a casting of said insulation from said blending step into said air blower, binding each said bound insulation bales with straps encircling each said bale individually, said disengaging being by shredding from a shredder comprising a plurality of drums, rotating said drums, measuring said force during said disengaging step, controlling said force in accordance with said measuring, said measuring of said force being with a strain gauge to determine deflections caused by said force, and providing wheels on said base for transporting said base.

51. The system of claim 1 including electronic means for determining the amount of insulation dispensed by said system.

52. The system of claim 1 including a computer means for automatically controlling the dispensing of said insulation by the system based upon various pre-selected parameters.

53. The system of claim 1 including electronic means for automatically shutting the system down once a pre-selected amount of said insulation has been dispensed.

54. The system of claim 51 wherein said electronic means comprises a position transducer.

55. The system of claim 51 wherein said electronic means comprises a position transducer which, when supplied with a known voltage, generates a second voltage which corresponds to a position of said movable wall.

56. The system of claim 54 wherein said electronic means further comprises a receiving means for receiving the voltage generated by said position transducer.

57. The system of claim 56 wherein said receiving means comprises a meter.

58. The system of claim 56 wherein said receiving means comprises a computer means.

59. The system of claim 58 wherein said computer means can be programmed to automatically control the dispensing of the insulation by the system based upon pre-selected variables.

60. The system of claim 58 wherein said computer means can be programmed to shut the system down for a relatively short period of time at pre-selected intervals.

61. A system for installing insulation from bound insulation bales comprising:

an elongated base for supporting said insulation for longitudinal movement relative to said base, said base having a dispensing end for said insulation and a distal end remote therefrom, insulation bale receiving apparatus positioned at said dispensing end for disengaging said insulation from said bale, a quantitative determinator connected to said system to determine the amount of insulation dispensed at said dispensing end, and an air blower for blowing said insulation out from said system onto a surface to be insulated.

62. A method for installing insulation in insulation bales comprising:

supporting said insulation bales on an elongated base, moving said insulation bales relative to said base toward a dispensing end from a distal end of said base remote therefrom, disengaging said insulation from said insulation bales, directing said insulation into an air blower for dispensing said insulation, and determining movement of said bales toward said dispensing end to determine the amount of insulation dispensed.

* * * * *

UNITED STATES PATENT AND TRADEMARK OFFICE

CERTIFICATE OF CORRECTION

PATENT NO. : 6,088,968
DATED : July 18, 2000
INVENTOR(S) : Everett S. Williston, Jr., Jack D. Coulter, Mark Trabbold, Michael J. Noone, David S. Rivers, Edward F. Pentz It is certified that error appears in the above-identified patent and that said Letters Patent is hereby corrected as shown below:

Claim 12,
Line 3, after "about" insert -- respective --; same line, after "axes" insert -- thereof --.

Claim 22,
Line 2, cancel "side" (first occurrence).

Claim 30,
Line 2, cancel "adjacent".
Line 3, after "respective" insert -- adjacent --.

Claim 36,
Line 6, correct spelling of "base".
Line 7, delete "e".

Claim 40,
Line 3, cancel "density".

Signed and Sealed this

Twenty-fifth Day of December, 2001

*Attest:*

*Attesting Officer*

JAMES E. ROGAN
*Director of the United States Patent and Trademark Office*